US006822630B2

(12) United States Patent
Moriwaki

(10) Patent No.: US 6,822,630 B2
(45) Date of Patent: Nov. 23, 2004

(54) LIQUID CRYSTAL DISPLAY DEVICE

(75) Inventor: Hiroyuki Moriwaki, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 380 days.

(21) Appl. No.: 09/798,219

(22) Filed: Mar. 2, 2001

(65) Prior Publication Data

US 2001/0030634 A1 Oct. 18, 2001

(30) Foreign Application Priority Data

Mar. 2, 2000 (JP) ..... 2000-057759
Feb. 20, 2001 (JP) ..... 2001-044282

(51) Int. Cl.[7] ..... G09G 3/36
(52) U.S. Cl. ..... 345/87; 345/98; 345/211
(58) Field of Search ..... 345/87–104, 204–214, 345/690, 699

(56) References Cited

U.S. PATENT DOCUMENTS 4,890,257 A 12/1989 Anthias et al. ..... 364/900
5,682,177 A * 10/1997 Kuwata et al. ..... 345/100
5,748,162 A * 5/1998 Hanami ..... 345/87
5,805,121 A * 9/1998 Burgan et al. ..... 345/50
5,867,140 A * 2/1999 Rader ..... 345/98
6,160,594 A 12/2000 Hanami et al. ..... 349/34
6,426,594 B1 * 7/2002 Ito ..... 315/169.1
6,522,319 B1 * 2/2003 Yamazaki ..... 345/103
2002/0005843 A1 * 1/2002 Kurumisawa et al. ..... 345/204
2003/0103018 A1 * 6/2003 Yokota et al. ..... 345/59

FOREIGN PATENT DOCUMENTS

EP 974952 A1 * 1/2000 ..... G09G/3/36
JP 4-97219 3/1992
JP 4-113314 4/1992
JP 6-149184 5/1994

OTHER PUBLICATIONS

Chris Taylor, Color Calibration of Computer Monitors, May 7, 1994, p. 7.*

* cited by examiner

*Primary Examiner*—Dennis-Doon Chow
(74) *Attorney, Agent, or Firm*—Edwards & Angell, LLP; David G. Conlin; George W. Hartnell, III

(57) ABSTRACT

A liquid crystal display device is arranged so that an effective value of an OFF voltage and an effective value of an ON voltage applied to a liquid crystal layer at a whole screen display time and at a partial screen display time substantially coincide with each other. More specifically, a bias ratio (a') at a partial screen display time is set not higher than an optimal bias value, and a maximum amplitude value of an applied voltage waveform (driving voltage) at the partial screen display time (driving voltage=$a'V_0'$) is smaller than that at the whole screen display time (driving voltage=$aV_0$). By so doing, a pulse-like voltage load applied to liquid crystal molecules during ON time is reduced, and a display defect level during ON time can be improved to a level equal to or above that at the whole screen display level.

8 Claims, 6 Drawing Sheets

V'(t): APPLIED VOLTAGE WAVEFORM
a' : BIAS RATIO
N' : DUTY NUMBER
$t'_f$: FRAME PERIOD
$V'_0$: POTENTIAL OF SIGNAL ELECTRODE ON WAVEFORM
$a'V'_0$: MAXIMUM AMPLITUDE VALUE (DRIVING VOLTAGE) (PARTIAL SCREEN DISPLAY)

FIG. 1 (a)

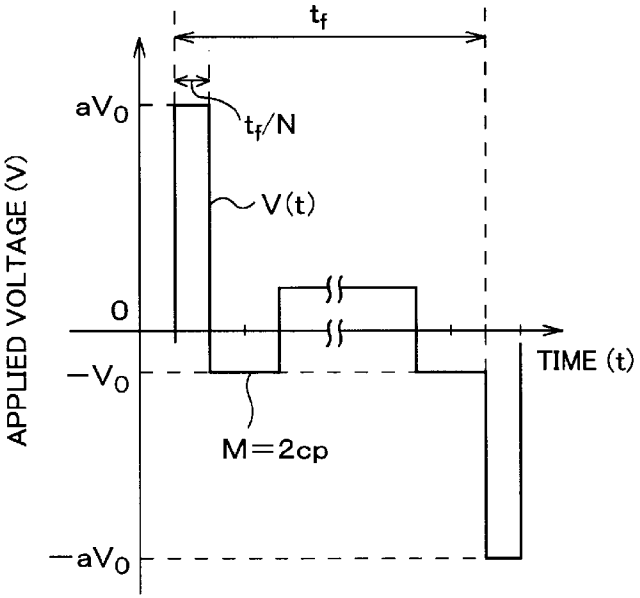

V(t): APPLIED VOLTAGE WAVEFORM
a: BIAS RATIO
N: DUTY NUMBER
$t_f$: FRAME PERIOD
$V_0$: POTENTIAL OF SIGNAL ELECTRODE ON WAVEFORM
$aV_0$: MAXIMUM AMPLITUDE VALUE (DRIVING VOLTAGE)
(WHOLE SCREEN DISPLAY)

FIG. 1 (b)

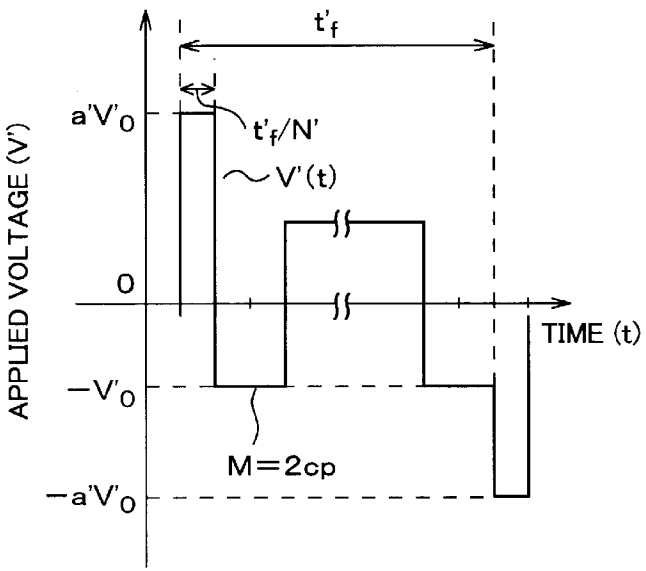

V'(t): APPLIED VOLTAGE WAVEFORM
a': BIAS RATIO
N': DUTY NUMBER
$t'_f$: FRAME PERIOD
$V'_0$: POTENTIAL OF SIGNAL ELECTRODE ON WAVEFORM
$a'V'_0$: MAXIMUM AMPLITUDE VALUE (DRIVING VOLTAGE)
(PARTIAL SCREEN DISPLAY)

11 ··· ABSORPTION AXIS DIRECTION OF POLARIZING PLATE
12 ··· SLOW AXIS DIRECTION OF UPPER PHASE DIFFERENCE PLATE (EXTENSION AXIS DIRECTION)
13 ··· SLOW AXIS DIRECTION OF LOWER PHASE DIFFERENCE PLATE (EXTENSION AXIS DIRECTION)
14 ··· UPPER RUBBING AXIS DIRECTION
15 ··· LOWER RUBBING AXIS DIRECTION

A ··· { OFF VOLTAGE POSITION OF WHOLE SCREEN DISPLAY
OFF VOLTAGE POSITION OF PARTIAL SCREEN DISPLAY }

B ··· ON VOLTAGE POSITION OF WHOLE SCREEN DISPLAY

C ··· ON VOLTAGE POSITION OF PARTIAL SCREEN DISPLAY

LIQUID CRYSTAL DISPLAY DEVICE

FIELD OF THE INVENTION

The present invention relates to a liquid crystal display device driven by switching whole screen display and partial screen display as required, for achieving low voltage driving of a portable telephone, etc.

BACKGROUND OF THE INVENTION

Recently, liquid crystal display (LCD) devices have been used for various purposes, for instance, as displays for use in portable information terminals, for the reason that they are thin in thickness and light in weight.

LCD devices are light-receiving-type elements that execute display by not emitting light per se but varying intensities of light permeated, and can be driven with a low effective voltage of about several volts. Therefore, by rendering an LCD device a reflection-type LCD device that executes display with external light reflected by a reflection plate provided beneath the device, it becomes a display element of extremely low power consumption. Further, by rendering such a reflection-type LCD device an STN-type LCD device driven by time division driving, the panel structure is simplified while low power consumption is enabled, and further low price is realized.

Here, time division driving is briefly explained. The time division driving is a driving method in which a selection waveform is applied to each scanning electrode line by line, while the same scanning is repeated when the selection waveform has been applied to all the scanning electrodes. Time while such a scanning is carried out is a frame period, and a frequency thereof is a frame frequency. Furthermore, a ratio of a time of selecting each scanning electrode (time necessary for applying the selection waveform to each scanning electrode) to a frame period is called a duty ratio.

In the time division driving, an electric field is applied not only to ON pixels but also to OFF pixels. Therefore, a threshold value characteristic becomes an essential condition determining electro-optical characteristic of the LCD device.

A waveform useful for control of a display state for the time division driving is applied during only a certain period of time determined according to the duty ratio, while a waveform having nothing to do with the control of a display state is applied for most of the rest of time. Liquid crystal responds to an applied waveform during the non-selection time, and to suppress a decrease of a display contrast (cross-talk phenomenon), it is necessary to make the effective voltage of the application waveform during non-selection time constant. This driving method in which the display state is made constant is called as amplitude selective addressing scheme. Incidentally, the term of the effective voltage means a square mean voltage of applied voltages in one frame period.

An LCD device performing the aforementioned time division driving, whose effective voltage upon driving is low, consumes very low power, as compared with an active-matrix-type LCD device having a high effective voltage upon driving. Therefore, it draws attention regarding application for carrying purpose, and many attempts for lower power consumption have been made by lowering a voltage upon driving.

To lower the power consumption of the LCD device, an approach of lowering the effective voltage of the LCD panel section is usually taken. In the foregoing approach, attempts for increasing a liquid crystal dielectric constant for lowering voltages upon driving are made day and night.

Furthermore, not only regarding the LCD panel section side, but also regarding the LCD driver side, attempts to decrease power consumption has been made: for instance, the Japanese Publication for Laid-Open Patent Application No. 97219/1992 (Tokukaihei 4-97219 [Publication Date: Mar. 30, 1992]), and the Japanese Publication for Laid-Open Patent Application No. 113314/1992 (Tokukaihei 4-113314 [Date of Publication: Apr. 14, 1992]) teach a driving method whereby contrast is improved by lowering the bias ratio in the time division driving.

Furthermore, regarding the liquid crystal driver, as a technique for more effectively lowering power consumption, like a technique applied to portable telephones or the like, a driving technique (partial driving) is applied in which a maximum amplitude value of a voltage waveform applied to a driver is lowered by switching the whole screen display to the partial screen display when the device is in the stand-by state. Such a partial driving technique is described in the Japanese Publications for Laid-Open Patent Applications No. 149184/1994, 207438/1998 (Tokukaihei 6-149184 [Date of Publication: May 27, 1994], Tokukaihei 10-207438 [Date of Publication: Aug. 7, 1998]).

The Japanese Publication for Laid-Open Patent Application No. 6-149184 (Tokukaihei 149184/1994) teaches a method for switching the whole screen display and the partial screen display, for partial driving, and more specifically, an LCD device that includes, in one and same LCD panel, portions displayed by driving at high duty and portions displayed by driving at low duty, and by switching the high-duty driving and the low-duty driving the LCD panel is formed smaller in size and that costs low. However, this publication teaches nothing about the driving conditions such as the setting of bias or frequency.

On the other hand, the Japanese Publication for Laid-Open Patent Application No. 10-207438 teaches driving conditions such as setting of bias for the partial driving. More specifically, in the amplitude selective addressing scheme, a ratio of an application voltage effective value of an ON voltage (hereinafter referred to as effective value of an ON voltage) to an application voltage effective value of an OFF voltage (hereinafter referred to as effective value of an OFF voltage) can be set as great as possible, and a bias ratio is set so as to be in a driver voltage-resistant range. However, the foregoing publication does not show anything about the setting of a frequency.

To decrease the effective voltage of the LCD device, as described above, it is indispensable to increase the dielectric constant of liquid crystal. However, ionic impurities taken into liquid crystal in the production process increase as the dielectric constant of liquid crystal increases. This raises a drawback in that reliability lowers, for instance, display defects are produced while turned ON.

On the other hand, as described above, as a driving voltage of a driver lowers by partial driving, low power consumption is realized in the LCD device as a whole. In an STN-type LCD device, in partial driving, a bias ratio is determined by the amplitude selective addressing method so that the driving voltage during ON time should be in a range of pressure resistance of the driver upon partial driving as well as that a ratio of an effective value of the ON voltage to an effective value of the OFF voltage can be as great as possible. Here, as shown in FIG. 4, when the effective value of the OFF voltage of partial screen display of the liquid crystal is made to coincide with the effective value of the OFF voltage of the whole screen display (the point of coincidence is indicated with A in the figure), an effective value of the ON voltage in the partial screen display (indicated with C in the figure) exceeds an effective value of the ON voltage of the whole screen display (denoted with B in the figure). Therefore, the power consumption of the liquid crystal display panel section in the partial image display increases as compared with that of the whole screen display.

Furthermore, an increase in the effective voltage value upon partial screen display causes the pulse voltage load applied to liquid crystal molecules to increase. Therefore, as shown in FIG. 5, display defects are produced at edges of the display area of the LCD panel, during partial screen display.

Furthermore, by making the effective value of the ON voltage of the partial screen display exceed the effective value of the ON voltage of the whole screen display, the voltage shifts from an optimal voltage, thereby causing color tones to lower.

SUMMARY OF THE INVENTION

An object of the present invention is to provide an LCD device that executes a driving operation (partial driving) by switching whole screen display and partial screen display as required, and that is further arranged so as to have driving conditions for setting the ON voltage and the OFF voltage at the partial screen display time, whereby optical characteristics such as color tone and contrast can be improved, no display defect is produced, and reliability is improved.

To achieve the foregoing object, an LCD device in accordance with the present invention is an LCD device that switches whole screen display and partial screen display as required, to perform time division driving, and the liquid crystal display device is characterized by comprising:

a driving circuit executing a driving operation in a manner such that an applied voltage effective value of an OFF voltage at the partial screen display time and an applied voltage effective value of an OFF voltage at the whole screen display time should substantially coincide with each other, as well as an applied voltage effective value of an ON voltage at the partial screen display time and an applied voltage effective value of an ON voltage at the whole screen display time should substantially coincide with each other.

As described above, in the case of an LCD device driven by switching the whole screen display and the partial screen display as required (partial driving), low power consumption of the device as a whole can be realized, since the driving voltage of the driver lowers. In addition to this, in the case of an LCD device of the present invention that carries out time division driving under the foregoing set conditions, since the applied voltage effective value of the OFF voltage at the partial screen display time and the applied voltage effective value of the OFF voltage at the whole screen display time should substantially coincide with each other, as well as the applied voltage effective value of the ON voltage at the partial screen display time and the applied voltage effective value of the ON voltage at the whole screen display time should substantially coincide with each other, no difference in optical characteristics is produced between the whole screen display while the OFF voltage is applied and the partial screen display while the OFF voltage is applied, as well as between the whole screen display while the ON voltage is applied and the partial screen display while the ON voltage is applied.

Therefore, even in the partial screen display at which conventionally display defects tend to occur as compared with the whole screen display, the display performance can be improved, to have equal levels to those at the whole screen display time, regarding the color tone, contrast, and even display defect level.

For a fuller understanding of the nature and advantages of the invention, reference should be made to the ensuing detailed description taken in conjunction with the accompanying drawings.

BRIEF DESCRIPTION OF THE DRAWINGS

FIG. 1(*a*) is a waveform diagram illustrating a waveform applied while whole screen display is ON, in the driving of an LCD device in accordance with one embodiment of the present invention.

FIG. 1(*b*) is a waveform diagram illustrating a waveform applied when partial screen display is ON, in the driving of the foregoing LCD device.

DESCRIPTION OF THE PREFERRED EMBODIMENTS

[First Embodiment]

The following description will explain an embodiment of the present invention while referring to FIGS. 1 through 3 and 6.

Figure 2:
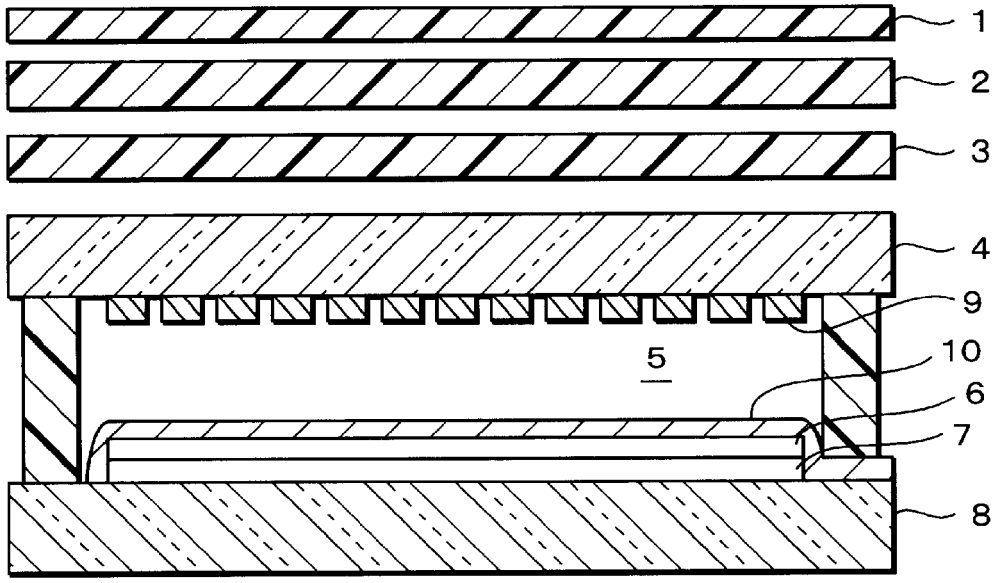
FIG. 2 is a cross-sectional view schematically illustrating an arrangement of an LCD panel used in the foregoing LCD device.

An LCD panel provided in an LCD device in accordance with the present embodiment is composed of, as shown in FIG. 2, from the top (observer side), a polarizing plate 1, an upper phase difference plate 2, a lower phase difference plate 3, an upper glass substrate 4, an upper electrode 9, an upper alignment film (not shown), a liquid crystal layer 5, a lower alignment film (not shown), a lower electrode 10, a color filter 6, a reflection plate 7, and a lower glass substrate 8, that are provided in the stated order.

A high-transmission high-polarization polarizing plate (available from Nitto Denko Corporation) is used in the foregoing polarizing plate 1. Furthermore, polycarbonate phase difference films are used in the foregoing upper phase difference plate 2 and the lower phase difference plate 3, while the upper phase difference plate 2 has a retardation of 665 nm with respect to a wavelength ($\lambda$)=550 nm, while the lower phase difference plate 3 has a retardation of 170 nm with respect to a wavelength ($\lambda$)=550 nm.

Furthermore, the upper alignment film and the lower alignment film provided so as to sandwich the liquid crystal layer 5 are for alignment of the liquid crystal layer 5, and the surface of the liquid crystal layer 5 has been subjected to rubbing in a predetermined direction. Liquid crystal of the STN (super twisted nematic)-type, having a twist angle of 240°, a high dielectric constant (dielectric anisotropy) of 14.2, and a refractivity anisotropy ($\Delta n$) of 0.132 with respect to a waveform (λ)=589 nm is used in the foregoing liquid crystal layer 5. Incidentally, in the present embodiment, STN-type liquid crystal is used as the liquid crystal layer 5, though not particularly limited.

The foregoing color filter 6 and the reflection plate 7 are arranged so as to be provided between the upper glass substrate 4 and the lower glass substrate 8. The foregoing reflection plate 7 is used as a dispersing reflection plate.

Figure 3:
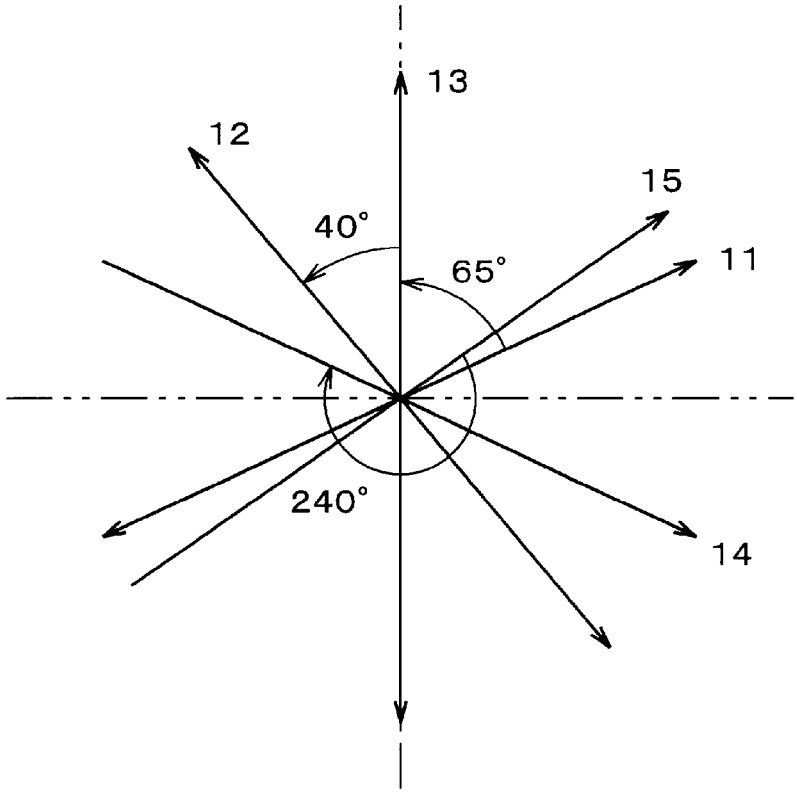
FIG. 3 is a view illustrating an optical axis arrangement of the foregoing LCD device.
Figure 4:
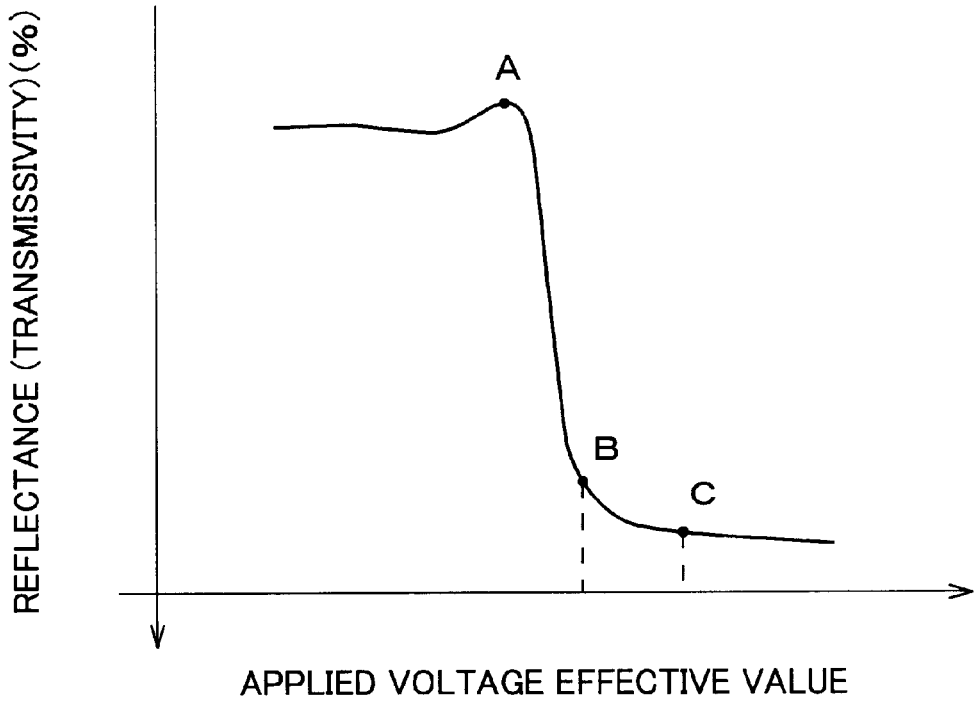
FIG. 4 is a graph illustrating relationship between a reflectance and an applied voltage effective value during whole screen display and that during partial screen display, in a conventional LCD device.

Incidentally, the polarizing plate 1, the upper phase difference plate 2, the lower phase difference plate 3, and upper and lower rubbing axes of the liquid crystal layer 5 are arranged as shown in FIG. 3.

Figure 6:
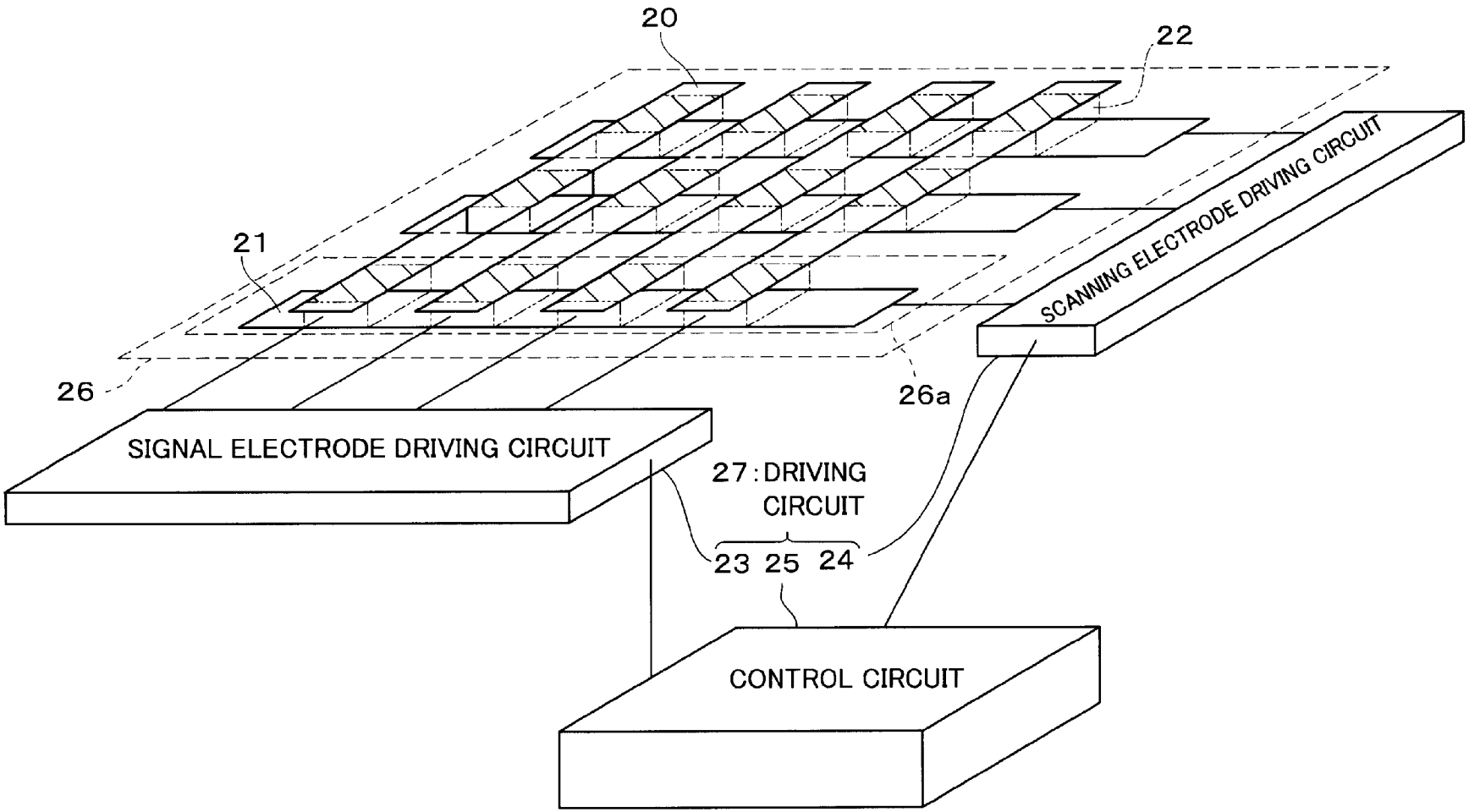
FIG. 6 is a perspective view illustrating an arrangement of an LCD device in accordance with an embodiment of the present invention.

The foregoing LCD panel, as shown in FIG. 6, includes a plurality of signal electrodes 20 and a plurality of scanning electrodes 21 arranged so as to cross each other to form matrix electrodes, and at intersections of the signal electrodes 20 and the scanning electrodes 21, pixels 22 are formed. The LCD device is, as a peripheral circuit, composed of a signal electrode driving circuit 23 for applying a signal voltage to signal electrodes 20, a scanning electrode driving circuit 24 for applying a scanning voltage to scanning electrodes 21, and a control circuit 25 for controlling the signal electrode driving circuit 23 and the scanning electrode driving circuit 24. The foregoing signal electrode driving circuit 23, scanning electrode driving circuit 24, and control circuit 25 constitute a driving circuit 27.

The scanning voltage is for sequential selection of each scanning electrode 21, and is composed of a selection voltage applied to the scanning electrodes 21 one by one during a selection period for making each scanning electrode 21 in a selected state, and a non-selection voltage applied during periods other than the selection period. The signal voltage is arranged so as to change to a first signal voltage that makes liquid crystal pixels turned ON, and a second signal voltage that makes liquid crystal pixels turned OFF, in response to display data.

The control circuit 25 is arranged so that whole screen display for displaying the whole liquid crystal panel 26 and partial screen display for displaying a permanent display area 26*a* as a part of the LCD panel should be switched. In the whole screen display, the number of duties of the scanning voltage is set to the total number of the scanning electrodes 21, and the selection voltage is successively applied to all the scanning electrodes 21.

On the other hand, in the partial screen display, the number of duties of the scanning voltage is set to the number of the scanning electrodes 21 in the permanent display area 26*a* (smaller than the number of duties of the whole screen display), and the selection voltage is applied to only the scanning electrodes 21 of the permanent display area 26*a* one by one.

In so doing, for instance, by switching the partial display screen in a non-operation period, it is possible to display necessary information in the permanent display area 26*a* in a non-operation period, while cutting down power to be applied to the scanning electrodes 21 other than those in the permanent display region 26*a*.

Incidentally, the LCD device is not limited to a reflection-type LCD device of the foregoing arrangement, but an LCD device of a transmission type.

Furthermore, as a method for driving an LCD device in accordance with the present embodiment, the time division driving method is employed. Here, the time division driving method will be briefly explained below. The time division driving method is a driving method in which a selection waveform is applied to the scanning electrodes line by line, and upon finishing the application of the selection waveform to the scanning electrodes, a scanning operation identical to the foregoing is repeated. Time required for carrying out such a scanning is referred to as a frame period ($t_f$), and a frequency thereof is referred to as a frame frequency ($1/t_f$). Furthermore, a ratio of a selection time of each scanning electrode (time necessary for applying a selection waveform to each scanning electrode) to a frame period ($t_f$) is called a duty ratio (1/N). Incidentally, a reciprocal N of the duty ratio (1/N) is called as duty number.

In the time division driving, an electric field is applied not only to ON pixels but also to OFF pixels. Therefore, a threshold value characteristic becomes an essential condition determining electro-optical characteristic of the LCD device. A waveform useful for control of a display state for the time division driving is applied during only a certain period of time determined according to the duty ratio (1/N), while a waveform having nothing to do with the control of a display state is applied for most of the rest of time. Liquid crystal responds to an applied waveform during the non-selection time, and to suppress a decrease of a display contrast (cross-talk phenomenon), it is necessary to make the effective voltage of the application waveform during non-selection time constant. This is to make display states at the ON pixels uniform as well as the display states at the OFF pixels uniform. This driving method in which the display state is made constant is called as amplitude selective addressing scheme.

Incidentally, the term of the effective voltage means a square mean voltage $V_{rms}$ defined as the following formula:

$$Vrms = \sqrt{\frac{1}{t_f}\int_0^{t_f}\{V(t)\}^2\,dt} \tag{1}$$

Furthermore, let a potential of a signal pulse inputted to the signal electrodes be $V_0$, and calculate the effective voltages $V_{ON}$ and $V_{OFF}$ applied to the ON and OFF pixels according to the formula 1, their results are expressed with the following third-order formulae. Incidentally, a represents a positive constant of a bias ratio.

$$V_{ON} = \sqrt{1 + \frac{a^2 - 1}{N}} \times V_0 \tag{2}$$

$$V_{OFF} = \sqrt{1 + \frac{a^2 - 4a + 3}{N}} \times V_0 \tag{3}$$

An LCD device in accordance with the present embodiment is arranged so that the OFF voltage effective value at the whole screen display time ($V_{OFF}$ at the whole screen display time) and the OFF voltage effective value at the partial screen display time ($V_{OFF}$ at the partial screen display time) should substantially coincide with each other, and that the effective value of the ON voltage at the whole screen display time ($V_{ON}$ at the whole screen display time) and the effective value of the ON voltage at the partial screen display time ($V_{ON}$ at the partial screen display time) should substantially coincide with each other.

By driving the LCD device under the foregoing set conditions, a difference in optical characteristics does not occur between the whole screen display and the partial screen display, in the ON voltage application and the OFF voltage application both. Therefore, at the partial screen display time in which display defects tend to easily occur and color tone impairment is also seen, color tone and contrast as well as display level concerning defects (hereinafter referred to as display defect level) can be made identical to those at the whole display time.

Furthermore, in the case where the OFF voltage effective value at the whole screen display time ($V_{OFF}$) and the OFF voltage effective value at the partial screen display time ($V_{OFF}$) are made to substantially coincide with each other, a difference therebetween is desirable such that: as to color tone, the color difference should only be at a level such that they are recognized as equal to each other with eyes, and a color difference ΔE*ab according to the L*a*b* colorimetric system desirably satisfies the following formula (4); and as to contrast, the difference is such that degradation of contrast of the partial screen display with respect to the contrast of the whole screen display is less than 10%.

$$\Delta E^*ab = \sqrt{(\Delta L^*)^2 + (\Delta a^*)^2 + (\Delta b^*)^2} < 3 \quad (4)$$

where L* represents a brightness index, a* and b* represent indices of chromaticness, and ΔE*ab represents a color difference according to the L*a*b* colorimetric system.

Further, in the case where the effective value of the ON voltage at the whole screen display time ($V_{ON}$ at the whole screen display time) and the effective value of the ON voltage of the partial screen display time ($V_{ON}$ at the partial screen display time) are made to coincide, a difference between the foregoing voltages is desirably at a level identical to that in the aforementioned case of the OFF voltage effective values.

In the case where the foregoing voltage effective values are made to coincide with each other, by setting the voltage difference therebetween in the foregoing range, the aforementioned effects, that is, the color tone, contrast, and display defect level identical to those in the whole screen display time, can be achieved.

Furthermore, in driving of the LCD device in accordance with the present embodiment, let a bias value that renders maximum a ratio of an effective value of the ON voltage ($V_{ON}$ of the partial screen display time) to an effective value of the OFF voltage ($V_{OFF}$ of the partial screen display time) determined by the amplitude selective addressing method be an optimal bias value, then, it is desirable that a value not higher than the optimal bias value should set as bias ratio (the bias value should be decreased from the optimal bias value). Further, here, the effective value of the ON voltage at the partial screen display time should be set equal to the effective value of the ON voltage at the whole screen display time.

In driving the LCD device in accordance with the present embodiment, the waveform applied when the whole screen display is ON and the waveform applied when the partial screen display is ON are set so that the bias ratio (a') for the partial screen display is equal to, or lower than, the optimal bias value, to make the voltage effective values applied to liquid crystal molecules of the liquid crystal layer 5 due to the ON voltages at the whole screen display and at the partial screen display be equal to each other. Therefore, as shown in FIGS. 1(*a*) and 1(*b*), a maximum amplitude value of the applied voltage waveform (driving voltage) at the partial screen display time (driving voltage=$a'V_0'$) becomes smaller than that for the whole screen display time (driving voltage=$aV_0$). Incidentally, in an STN-type LCD device like the LCD device in accordance with the present embodiment, the bias ratio is determined so that the ratio of the effective value of the ON voltage to the effective value of the OFF voltage at the whole screen display time becomes as great as possible. In other words, an optimal bias value is used as a bias ratio (a) for the whole screen display time.

As described above, since the maximum amplitude value $a'V_0'$ (driving voltage) of the applied voltage waveform at the partial screen display time is smaller than the maximum amplitude value $aV_0$ (driving voltage) of the applied voltage waveform at the whole screen display, the pulse-like voltage load applied to liquid crystal molecules of the liquid crystal layer 5 when the partial screen display is ON is reduced. This enables enhancement of the display defect level occurring when the partial screen display time to a level equal to that at the whole screen display time. Furthermore, the lowering of the maximum amplitude value (driving voltage) $a'V_0'$ at the partial screen display time makes it possible to lower the voltage-resistance level of the liquid crystal driver, whereby the power consumption of the liquid crystal driver at the partial screen display time can be suppressed at the same time.

Here, a non-synchronization M signal (indicated with M in the figure) is a signal applied by increasing alternate current components in the applied voltage waveform, aiming at decreasing display defects that occur during ON time. Incidentally, the non-synchronization M signals shown in FIGS. 1(*a*) and 1(*b*) are both arranged so that M=2 cp, as to the whole screen display and the partial screen display. Incidentally, the value of M indicates how many lines are present since one polarity inversion to next polarity inversion, and the value M can be a value other than 2 cp.

Furthermore, in the LCD device in accordance with the present embodiment, the frequency and bias ratio of the non-synchronization M signal of the applied voltage waveform at the partial screen display time are set so that the following relationship should be satisfied.

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE DISPLAY TIME)≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME) (5)

Incidentally, the frequency of the non-synchronization M signal of the applied voltage waveform is determined as follows:

(FREQUENCY OF NON-SYNCHRONIZATION M SIGNAL)=(FRAME FREQUENCY)/2×(DUTY RATIO)/(NON-SYNCHRONIZATION M SIGNAL) (6)

First of all, the non-synchronization M signal is a signal that is applied by increasing alternate current components in the applied voltage waveform, aiming at decreasing display defects that occur while the LCD device is turned on. Generally, the driving waveforms are roughly classified into a category of line inversion in which the polarity is inverted at every other line, and a category of frame inversion in which the polarity is inverted at every frame, and the setting of the non-synchronization M signal is the setting for determining how many lines should be present from one inversion of polarity until to next inversion of polarity. For instance, M=1 cp indicates line inversion, while M=Ncp indicates frame inversion. Note that herein N is indicative of the number of duty.

Therefore, by satisfying the relationship expressed by the foregoing formula (5) by lowering the maximum amplitude value of the applied waveform at the partial screen display time and making the reciprocal of the frequency of the non-synchronization M signal of the applied voltage waveform smaller, the display defect level of the LCD device in accordance with the present embodiment while the device is turned on, at the partial screen display time is improved. By so doing, the display defect level of the partial screen display time while the ON voltage is applied is improved so as to be identical to the display defect level at the partial screen display time while the ON voltage is applied. The reason is considered as follows.

Generally, the display defects during ON time are caused by adhesion of ionic impurities contained in the liquid crystal layer to an alignment film while turned on that in turn causes partial distortion of an electric field. This problem can be solved by preventing the ionic impurities in the liquid crystal layer from adhering to the alignment film. The following two approaches to the problem are thought of:

(1) to make the maximum amplitude value smaller, so as to make an electric field applied to the ionic impurities at a unit time smaller, thereby causing the ionic impurities to move less in the liquid crystal layer (an approach related with the maximum amplitude value of the applied voltage waveform);

(2) to cause polarity inversion of the driving waveform to occur more often (to approximate the times of inversion to that in the line inversion), so as to shorten the time in which the ionic impurities move in a predetermined direction in the liquid crystal layer, thereby preventing the same from adhering to the alignment film (an approach related with the frequency of the non-synchronization M signal).

Therefore, by satisfying the foregoing expression of relationship, it is possible to improve the display defect level at the partial screen display time while the ON voltage is applied so as to be equal to, or above, that of the display defect level at the whole screen display time.

Incidentally, the display level is improved as the number of times of polarity inversion of the applied voltage waveform, whereas this raises a problem of an increase in the power consumption. Therefore, it is necessary to set the number of times of polarity inversion to at least a level such that display defects should not occur.

The following description will explain the LCD device depicted in the foregoing embodiment of the present invention, referring to concrete numerical values.

EXAMPLE 1

The following description will explain respective set values and driving conditions for the whole screen display time and for the partial screen display time, concerning an LCD device of the present example.

TABLE 1

| | WHOLE SCREEN DISPLAY TIME | PARTIAL SCREEN DISPLAY TIME |
|---|---|---|
| DUTY NUMBER | N = 66 | N' = 26 |
| FRAME FREQUENCY | $1/t_f$ = 80 (Hz) | $1/t_f'$ = 115 (Hz) |
| NON-SYNCHRONIZATION M SIGNAL | M = 7 (cp) | M' = 5 (cp) |
| BIAS RATIO | a = 9 | a' = 6 |

As shown in FIG. 1, the bias ratio (a) for the whole screen display was set to ⅙ bias (equivalent to bias ratio a=9), using an optimal bias value that maximizes a ratio of an effective value of the ON voltage (whole screen display $V_{ON}$) to an effective value of the OFF voltage (whole screen display $V_{OFF}$) according to the amplitude selective addressing method. Here, the maximum amplitude value (driving voltage) $aV_0$ at the whole screen display time while the ON voltage was applied was 9.4(V).

Then, effective values of the OFF voltages at the partial screen display time and at the whole screen display time were made substantially equal to each other. Furthermore, an optimal bias value that maximizes a ratio ($V_{ON}/V_{OFF}$) between an effective value of the ON voltage (partial screen display $V_{ON}$) and an effective value of the OFF voltage (partial screen display $V_{OFF}$) at the partial screen display determined by the amplitude selective addressing method was set as bias ratio, and an effective value of the ON voltage at the partial screen display and an effective value of the ON voltage at the whole screen display were made substantially equal. In the present example, it was set to ⅙ bias (equivalent to an optimal bias value=6). Here, a maximum amplitude value (driving voltage) $a'V_0'$ at the partial screen display time was 6.5(V).

Thus, since the maximum amplitude value (driving voltage) at the partial screen display time was smaller than the maximum amplitude value (driving voltage) at the whole screen display time, the power consumption of the liquid crystal driver was suppressed, while the pulse- like voltage load applied to liquid crystal molecules was reduced.

Furthermore, calculation using the aforementioned formula (2) results in that an effective value of the ON voltage at the whole screen display (whole screen display $V_{ON}$) is 1.55(V), and an effective value of the ON voltage of the partial screen display (partial screen display $V_{ON}$) is 1.66 (V). In this case, a difference between the whole screen display $V_{ON}$ and the partial screen display $V_{ON}$ becomes 0.11(V), and since the ON voltage of the partial screen display provides improvement of contrast as compared with conventional cases and produces significant difference from the whole screen display time in terms of color tone, the ON voltage of the partial screen display can be regarded as substantially coinciding with the ON voltage of the whole screen display. Here, a ratio of the application voltage effective value 1.66(V) of the ON voltage at the partial screen display time to the application voltage effective value 1.55(V) of the ON voltage at the whole screen display is 1.66(v)/1.55(V)=1.071, and a difference of the application voltage effective value of the ON voltage at the partial screen display time from an application voltage effective value of the ON voltage at the whole screen display is 7.1%, which is not more than 8%.

Furthermore, here, calculation using the formula (6) results in that a frequency of a non-synchronization M signal of the application voltage waveform at the whole screen display is 377 Hz, and likewise, that a frequency of a non-synchronization M signal of the application voltage waveform at the partial screen display is 299 Hz. Therefore, an LCD device of the present example satisfies the relationship formula (5) as follows:

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE SCREEN DISPLAY TIME)=9.4×1/377=0.0249≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME)=6.5×1/299=0.0217.

Therefore, the display defect level upon the ON voltage application at the partial screen display time is improved so as to be equal to that at the whole screen display time.

Figure 5:
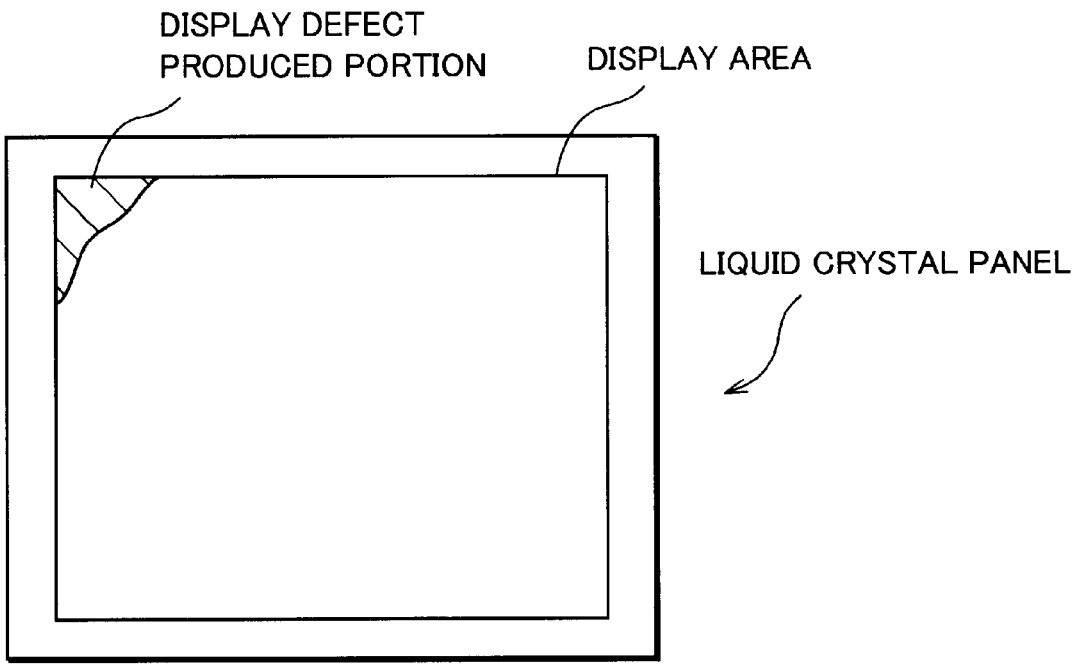
FIG. 5 is an explanatory view illustrating display defects that are produced in the conventional LCD device.

Subsequently, by applying to the LCD device a voltage of 6.5×1.1(V) that is 1.1 times the driving voltage of the ON voltage at the partial screen display time at 25° C. under the driving conditions shown in the present example, an acceleration test was carried out by partial screen display driving in a thermostatic chamber at 70° C. The result showed that display defects as shown in FIG. 5 occurred when 300 hours had passed. Furthermore, as to the whole screen display, an identical test was carried out under the driving conditions at the partial screen display time: that is, a voltage 9.4×1.1(V) that is 1.1 times the driving voltage of the ON voltage at the whole screen display time at 25° C., an acceleration test was carried out by whole screen display driving in a thermostatic chamber at 70° C. Consequently, display defects as shown in FIG. 5 occurred when 240 hours had passed. Thus, the results show that, even in the case where a life test was carried out under tough conditions like those described above, the LCD device in accordance with the present example provides a partial screen display that is capable of maintaining a display level equal to, or better than, the display level of the whole screen display.

EXAMPLE 2

Respective set values and driving conditions for the whole screen display time and for the partial screen display time concerning an LCD device of the present example are as follows.

TABLE 2

| | WHOLE SCREEN DISPLAY TIME | PARTIAL SCREEN DISPLAY TIME |
|---|---|---|
| DUTY NUMBER | N = 66 | N' = 26 |
| FRAME FREQUENCY | $1/t_f$ = 80 (Hz) | $1/t_f'$ = 115 (Hz) |
| NON-SYNCHRONIZATION M SIGNAL | M = 7 (cp) | M' = 5 (cp) |
| BIAS RATIO | a = 9 | a' = 3, or 2 |

As shown in Table 2, driving conditions for the whole screen display of the present embodiment are identical to Example 1, and utilizing an optimal bias value that maximizes a ratio $V_{ON}/V_{OFF}$ of an effective value of an ON voltage (whole screen $V_{ON}$) and an effective value of an OFF voltage (whole screen $V_{OFF}$) determined by the amplitude selective addressing method, ⅛ bias (equivalent to bias ratio a=9) was set. The maximum amplitude value (driving voltage) $aV_0$ at the whole screen display was 9.4(V).

Subsequently, effective values of OFF voltages at the partial screen display and the whole screen display were made to coincide with each other. Furthermore, at the partial screen display, a value lower than the optimal bias value determined by the amplitude selective addressing method was set as the bias ratio (a'), and the effective value of the ON voltage for the partial screen display and the effective value of the ON voltage for the whole screen display are made to substantially coincide with each other. More specifically, a bias value (a') for the partial screen display is determined by lowering the bias value from ⅙ bias (equivalent to a bias ratio a'=6) by using the optimal bias value at the partial screen display time, thereby to be set to ⅓ bias (equivalent to a bias ratio a'=3) or ½ bias (equivalent to a bias ratio a'=2).

As a result of the setting of the bias ratio (a') at the partial screen display time, maximum amplitude value (driving voltage) $a'V_0'$ at the partial screen display time is 4.1(V) at ⅓ bias, and 2.8(V) at ½ bias, which are lower than the driving voltage of 9.4(V) at the whole screen display time. An effective value of the ON voltage for the whole screen display was 1.55(V), while an effective value of the ON voltage for the partial screen display was 1.56(V) at ⅓ bias, or 1.48 (V) at ½ bias.

As described above, a difference of 0.01(V) at ⅓ bias, or 0.07(V) at ½ bias was produced between the effective values of ON voltages for the whole screen display and at the partial screen display, whereas no substantial differences were seen between color tones and contrasts thereof. Therefore, the effective values of the ON voltages for the whole screen display and for the partial screen display were regarded as equal. Concerning the color tone and the contrast, the effective voltages of the ON voltages for the whole screen display and at the partial screen display can be regarded as substantially equal to each other.

Here, calculation using the formula (6) results in that a frequency of a non-synchronization M signal of an applied voltage waveform for the whole screen display is 377 Hz, and that a frequency of a non-synchronization M signal of an applied voltage waveform for the partial screen display is 299 Hz. Therefore, in the case of ⅓ bias, the relationship expressed by the formula (5) is satisfied as follows:

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE SCREEN DISPLAY TIME)=9.4×1/377=0.0249 ≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME)=2.8×1/299=0.00936.

Likewise, in the case of ½ bias as well, the relationship expressed by the formula (5) is satisfied as follows:

(MAXIMUM AMPLITUDE VALUE OF APPLIED VOLTAGE WAVEFORM AT WHOLE SCREEN DISPLAY)×((RECIPROCAL OF FREQUENCY OF NON-SYNCHRONIZATION M SIGNAL OF APPLIED VOLTAGE WAVEFORM AT WHOLE SCREEN DISPLAY)=9.4×1/377=0.0249≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME)=4.1×1/299=0.0137.

Therefore, as compared with the case of Example 1, generation of display defects for the partial screen display while the device is turned on is suppressed, and it is possible to improve the display defect level at the partial screen display time while the ON voltage is applied to a level substantially equal to, or better than, the level at the whole screen display time.

Subsequently, by applying a voltage that is 1.1 times the driving voltage for the partial screen display time at 25° C. under the bias driving conditions (⅓ bias, ½ bias) of the present example at 25° C., that is, a voltage of 4.1×1.1(V) at ⅓ bias, and a voltage of 2.8×1.1(V) at ½ bias, an acceleration test was carried out by partial screen display driving in a thermostatic chamber at 70° C. The result showed that display defects as shown in FIG. 5 did not occurred according to the observation carried out for 500 hours. On the other hand, by applying an identical acceleration test was carried out with respect to the whole screen display, display defects as shown in FIG. 5 occurred when 240 hours had passed as described in Example 1. Thus, the results show that, even in the case where a life test was carried out under tough conditions as those described above, the LCD device in accordance with the present embodiment provides a partial screen display that is capable of maintaining a display level equal to, or better than, the display level of the whole screen display.

Thus, in the present example, by setting the bias ratio (a') of the partial screen display lower than the optimal bias value, the maximum amplitude value (driving voltage) can be lower than the case of Example 1. Therefore, it is possible to further improve the display defect level at the partial screen display time, whereby a display defect level substantially equal to the level at the whole screen display time can be realized.

EXAMPLE 3

The following description will explain driving conditions for the whole screen display time and for the partial screen display time of an LCD device in accordance with the present embodiment.

Driving conditions of the whole screen display of the present embodiment are identical to those in Examples 1 and 2, and utilizing optimal bias values that maximize an effective value of an ON voltage (whole screen $V_{ON}$) and an effective value of an OFF voltage (whole screen $V_{OFF}$) determined by the amplitude selective addressing method, 1/9 bias (equivalent to bias ratio a=9) was set. The maximum amplitude value (driving voltage) $aV_0$ for the whole screen display time was 9.4(V).

Subsequently, effective values of the OFF voltages for the partial screen display and for the whole screen display are made to coincide with each other. Furthermore, by raising the effective value of the ON voltage for the partial screen display from the optimal bias value determined by the amplitude selective addressing method for the partial screen display, the effective value of the ON voltage at the partial screen display time and the effective value of the ON voltage at the whole screen display time were made to coincide with each other. More specifically, it is set to 1/14 bias (equivalent to a bias ratio a'=14), increased from 1/6 bias utilizing an optimal bias value. The driving voltage for the partial screen display was 7.5 (V), and it can be made lower to some extent than the driving voltage for the whole screen display.

However, in this case, the formula (5) is not satisfied as follows:

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE SCREEN DISPLAY TIME)=9.4×1/377=0.0249≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME)=7.5×1/299=0.0251.

Therefore, the partial screen display driving was performed in a thermostatic chamber at 70° C. by applying a voltage of 7.5×1.1(V), that is, 1.1 times the driving voltage of the ON voltage at the partial screen display time at 25° C. The result showed that display defects as shown in FIG. 5 occurred when 240 hours had passed.

The results of Examples 1, 2, and 3 are compiled as shown in the following Table 3.

TABLE 3

| | EXAMPLE 1 | EXAMPLE 2 | | EXAMPLE 3 |
|---|---|---|---|---|
| BIAS RATIO AT PARTIAL SCREEN DISPLAY (OPTIMAL BIAS VALUE = 6) | 6 | 3 | 2 | 14 |
| DRIVING VOLTAGE AT PARTIAL SCREEN DISPLAY WHILE TURNED ON (V) | 6.5 | 4.1 | 2.8 | 7.5 |
| TIME UNTIL DISPLAY DEFECT OCCURRED IN ACCELERATION TEST (H) | 300 | DID NOT OCCUR AT 500 | | 240 |

Looking at the results of Examples 1, 2, and 3, the effective values of the ON voltage and the effective value of the OFF voltage are made to coincide with each other at the partial screen display time and at the whole screen display time (corresponding to all the cases of Examples 1, 2, and 3), the display defect level at the partial screen display time is improved, so as to approximates to the display defect level at the whole screen display time.

Furthermore, upon making the effective values of the ON voltages at the partial screen display time and at the whole screen display time coincide with each other, a bias ratio at the partial screen display time lower than the optimal bias value (equivalent to Example 2), the driving voltage at the partial screen display time can be set considerably lower, and it is possible to drastically improve the reliability of the display defect level during ON time.

Furthermore, by setting conditions so as to satisfy the relationship formula (5) (equivalent to Examples 1 and 2), it is possible to make the partial screen display to have a display performance at a level almost equal to that of the whole screen display. Furthermore, the result in the acceleration test showed that the partial screen display causes less display defects as compared with the whole screen display.

As described above, an LCD device in accordance with the present invention is an LCD device that switches whole screen display and partial screen display as required, to perform time division driving, and the liquid crystal display device is arranged so that a driving circuit executing a driving operation in a manner such that an applied voltage effective value of an OFF voltage at the partial screen display time and an applied voltage effective value of an OFF voltage at the whole screen display time should substantially coincide with each other, as well as an applied voltage effective value of an ON voltage at the partial screen display time and an applied voltage effective value of an ON voltage at the whole screen display time should substantially coincide with each other. Therefore, no difference in optical characteristics is produced between the whole screen display while the OFF voltage is applied and the partial screen display while the OFF voltage is applied, as well as between the whole screen display while the ON voltage is applied and the partial screen display while the ON voltage is applied. Therefore, the following effect can be achieved: even in the partial screen display at which conventionally display defects tend to occur as compared with the whole screen display, the display performance can be improved, to have equal levels to those at the whole screen display time, regarding the color tone, contrast, and even display defect level.

Furthermore, an LCD device in accordance with the present invention is preferably arranged so that a difference of the applied voltage effective value of the OFF voltage at the partial screen display time from the applied voltage effective value of the OFF voltage at the whole screen display time is in a range of not more than 8 percent of the applied voltage effective value of the OFF voltage at the whole screen display time, and a difference of the applied voltage effective value of the ON voltage at the partial screen display time from the applied voltage effective value of the ON voltage at the whole screen display time is in a range of not more than 8 percent of the applied voltage effective value of the ON voltage at the whole screen display time.

Furthermore, the LCD device in accordance with the present invention is preferably arranged so that a voltage difference between the applied voltage effective value of the OFF voltage at the partial screen display time and the applied voltage effective value of the OFF voltage at the whole screen display time is set so as to be not more than 0.11V, and a voltage difference between the applied voltage effective value of the ON voltage at the partial screen display time and the applied voltage effective value of the ON voltage at the whole screen display time is set so as to be not more than 0.11V.

Furthermore, the LCD device in accordance with the present invention is preferably arranged so that the applied voltage effective value of the ON voltage at the partial screen display time and the applied voltage effective value of the ON voltage at the whole screen display time are set, and the applied voltage effective value of the OFF voltage at the partial screen display time and the applied voltage effective value of the OFF voltage at the whole screen display time are set, so that a decrease in contrast of the partial screen display with respect to contrast of the whole screen display should be less than 10 percent. Therefore, the following effect can be achieved: even at the partial screen display time, contrast and display defect level equal to those at the whole screen display time can be realized.

Furthermore, the LCD device in accordance with the present invention is preferably arranged so that the applied voltage effective value of the ON voltage at the partial screen display time and the applied voltage effective value of the ON voltage at the whole screen display time are set, and the applied voltage effective value of the OFF voltage at the partial screen display time and the applied voltage effective value of the OFF voltage at the whole screen display time are set, so that a color difference ΔE*ab according to the L*a*b* table color system should satisfy:

$$\Delta E^*ab = \sqrt{(\Delta L^*)^2 + (\Delta a^*)^2 + (\Delta b^*)^2} < 3 \quad (4)$$

where L* represents a brightness index, a* and b* represent indices of chromaticness, and ΔE*ab represents a color difference according to the L*a*b* colorimetric system. By satisfying the foregoing relationship, the display defect level while the ON voltage is applied at the partial screen display time can be improved to a level substantially equal to the level at the whole screen display time.

Furthermore, the liquid crystal display device in accordance with the present invention is preferably arranged so that a bias ratio at the partial screen display time is set lower than an optimal bias value, the optimal bias value being a bias value that maximizes a ratio of the applied voltage effective value of the ON voltage to the applied voltage effective value of the OFF voltage at the partial screen display time determined by the amplitude selective addressing method, and the applied voltage effective value of the ON voltage at the partial screen display time is set so as to substantially coincide with the applied voltage effective value of the ON voltage at the whole screen display time. Therefore, the maximum amplitude value (driving voltage) of the ON voltage at the partial screen display time is smaller than the maximum amplitude value (driving voltage) at the whole screen display, and hence, the pulse-like voltage load applied to liquid crystal molecules at the partial screen display time is reduced. This enables enhancement of the display defect level occurring when the partial screen display time to a level equal to that at the whole screen display time. Furthermore, the lowering of the maximum amplitude value (driving voltage) at the partial screen display time makes it possible to lower the voltage-resistance level of the liquid crystal driver, whereby the power consumption of the liquid crystal driver at the partial screen display time can be suppressed at the same time.

Furthermore, the LCD device in accordance with the present invention is preferably arranged so that a frequency of a non-synchronization M signal of an applied voltage waveform at the partial screen display and the bias ratio are set so as to satisfy:

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE SCREEN DISPLAY TIME)≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME)

By satisfying the foregoing relationship, the display defect level in the partial screen display of the LCD device during ON time is improved. This enables achievement of the following effect: the display defect level at the partial screen display time while the ON voltage is applied can be improved to a level substantially equal to the level at the whole screen display time.

Furthermore, a portable information terminal in accordance with the present invention is arranged so as to be equipped with a liquid crystal display device as set forth above. This arrangement enables achievement of the following effect: a portable information terminal in which display performance of the partial screen display is improved, while power consumption is suppressed.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A liquid crystal display device having a layer of super twisted nematic liquid crystal that switches whole screen display and partial screen display as required, each of the whole screen display and the partial screen display having a number of duties, to perform time division driving, said liquid crystal display device comprising:

a driving circuit executing a driving operation in a manner such that an applied voltage effective value of an OFF voltage at the partial screen display time and an applied voltage effective value of an OFF voltage at the whole screen display time should substantially coincide with each other, as well as an applied voltage effective value of an ON voltage at the partial screen display time and an applied voltage effective value of an ON voltage at the whole screen display time should substantially coincide with each other, wherein the number of duties between the full screen display and the partial screen display differs and a first bias ratio defined as a ratio of the applied voltage effective value of the ON voltage to the applied voltage effective value of the OFF voltage at the whole screen display time becomes as great as possible and a second bias ratio defined as a ratio of the applied voltage effective value of the ON voltage to the applied voltage effective value of the OFF voltage at the partial screen display time is less than or equal to the first bias ratio.

2. The liquid crystal display device as set forth in claim 1, wherein:

a difference of the applied voltage effective value of the OFF voltage at the partial screen display time from the applied voltage effective value of the OFF voltage at the whole screen display time is in a range of not more than 8 percent of the applied voltage effective value of the OFF voltage at the whole screen display time; and a difference of the applied voltage effective value of the ON voltage at the partial screen display time from the applied voltage effective value of the ON voltage at the whole screen display time is in a range of not more than 8 percent of the applied voltage effective value of the ON voltage at the whole screen display time.

3. The liquid crystal display device as set forth in claim 1, wherein:

a voltage difference between the applied voltage effective value of the OFF voltage at the partial screen display time and the applied voltage effective value of the OFF voltage at the whole screen display time is set so as to be not more than 0.11V; and a voltage difference between the applied voltage effective value of the ON voltage at the partial screen display time and the applied voltage effective value of the ON voltage at the whole screen display time is set so as to be not more than 0.11V.

4. The liquid crystal display device as set forth in claim 1, wherein:

the applied voltage effective value of the ON voltage at the partial screen display time and the applied voltage effective value of the ON voltage at the whole screen display time are set, and the applied voltage effective value of the OFF voltage at the partial screen display time and the applied voltage effective value of the OFF voltage at the whole screen display time are set, so that a decrease in contrast of the partial screen display with respect to contrast of the whole screen display should be less than 10 percent.

5. The liquid crystal display device as set forth in claim 1, wherein:

the applied voltage effective value of the ON voltage at the partial screen display time and the applied voltage effective value of the ON voltage at the whole screen display time are set, and the applied voltage effective value of the OFF voltage at the partial screen display time and the applied voltage effective value of the OFF voltage at the whole screen display time are set, so that a color difference ΔE*ab according to the L*a*b* table color system should satisfy:

$$\Delta E^*ab = \sqrt{(\Delta L^*)^2 + (\Delta a^*)^2 + (\Delta b^*)^2} < 3 \quad (4)$$

where L* represents a brightness index, a* and b* represent indices of chromaticness, and ΔE*ab represents a color difference according to the L*a*b* colorimetric system.

6. The liquid crystal display device as set forth in claim 1, wherein:

a bias ratio at the partial screen display time is set lower than an optimal bias value, said optimal bias value being a bias value that maximizes a ratio of the applied voltage effective value of the ON voltage to the applied voltage effective value of the OFF voltage at the partial screen display time determined by the amplitude selective addressing method; and the applied voltage effective value of the ON voltage at the partial screen display time is set so as to substantially coincide with the applied voltage effective value of the ON voltage at the whole screen display time.

7. The liquid crystal display device as set forth in claim 1, wherein:

a frequency of a non-synchronization M signal of an applied voltage waveform at the partial screen display and the bias ratio are set so as to satisfy:

(MAXIMUM AMPLITUDE VALUE OF APPLIED VOLTAGE WAVEFORM AT WHOLE SCREEN DISPLAY TIME)×(RECIPROCAL OF FREQUENCY OF NON-SYNCHRONIZATION M SIGNAL OF APPLIED VOLTAGE WAVEFORM AT WHOLE SCREEN DISPLAY TIME)≧

(MAXIMUM AMPLITUDE VALUE OF APPLIED VOLTAGE WAVEFORM AT PARTIAL SCREEN DISPLAY TIME)×(RECIPROCAL OF FREQUENCY OF NON-SYNCHRONIZATION M SIGNAL OF APPLIED VOLTAGE WAVEFORM AT PARTIAL SCREEN DISPLAY TIME).

8. A portable information terminal that is equipped with a liquid crystal display device as set forth in claim 1.

* * * * *